US011095069B2

(12) United States Patent
Chaize et al.

(10) Patent No.: US 11,095,069 B2
(45) Date of Patent: Aug. 17, 2021

(54) COUPLING MEMBER FOR ELECTRICAL CONNECTION

(71) Applicant: Siemens Aktiengesellschaft, Munich (DE)

(72) Inventors: Eric Chaize, Dalton-in-Furness (GB); Philip Rogan, Dalton-in-Furness (GB)

(73) Assignee: Siemens Aktiengesellschaft, Munich (DE)

( * ) Notice: Subject to any disclaimer, the term of this patent is extended or adjusted under 35 U.S.C. 154(b) by 0 days.

(21) Appl. No.: 16/647,158

(22) PCT Filed: Sep. 17, 2018

(86) PCT No.: PCT/EP2018/075029

§ 371 (c)(1),
(2) Date: Mar. 13, 2020

(87) PCT Pub. No.: WO2019/063331

PCT Pub. Date: Apr. 4, 2019

(65) Prior Publication Data

US 2021/0075149 A1 Mar. 11, 2021

(30) Foreign Application Priority Data

Sep. 29, 2017 (GB) ..... 1715827

(51) Int. Cl.
*H01R 13/523* (2006.01)
*H01R 13/502* (2006.01)
(Continued)

(52) U.S. Cl.
CPC ..... *H01R 13/523* (2013.01); *H01R 13/502* (2013.01); *H01R 13/5202* (2013.01); *H01R 13/648* (2013.01)

(58) Field of Classification Search
CPC ..... H01R 13/523; H01R 13/502; H01R 13/5202; H01R 13/648
(Continued)

(56) References Cited

U.S. PATENT DOCUMENTS 5,823,257 A * 10/1998 Peyton ..... E21B 17/028 166/65.1
6,511,335 B1 * 1/2003 Rayssiguier ..... H01R 13/523 439/191
(Continued)

FOREIGN PATENT DOCUMENTS

CN 102742084 A 10/2012
CN 108092061 A 5/2018
(Continued)

*Primary Examiner* — Peter G Leigh
(74) *Attorney, Agent, or Firm* — Wolter Van Dyke Davis, PLLC

(57) ABSTRACT

A wet-mateable coupling member for making an electrical connection having: a body having a cavity wall which defines an internal cavity, and a hollow sleeve located inside the internal cavity. The sleeve is arranged in the internal cavity to define: an outer chamber between the sleeve and the cavity wall. The sleeve defines an inner chamber inside the sleeve. The sleeve has an electrically-insulating layer and an electrically-conductive layer. The electrically-conductive layer defines an outer surface of the sleeve in the outer chamber and has a semi-conductive layer, the semi-conductive layer being a conductive elastomer. An electrical contact is adapted to be housed inside the inner chamber and configured for making the electrical connection.

11 Claims, 4 Drawing Sheets

(51) Int. Cl.
*H01R 13/52* (2006.01)
*H01R 13/648* (2006.01)

(58) Field of Classification Search
USPC ..... 439/141
See application file for complete search history.

(56) References Cited

U.S. PATENT DOCUMENTS 7,074,064 B2 * 7/2006 Wallace ..... H01R 13/523 166/65.1
7,614,894 B2 * 11/2009 M.ae butted.land ..... H01R 13/523 439/201
8,376,765 B2 * 2/2013 Chaize ..... E21B 33/0385 439/201
8,376,922 B2 * 2/2013 Akama ..... G03G 15/0818 492/56
8,668,509 B2 * 3/2014 Chaize ..... H01R 13/6277 439/271
8,897,675 B2 * 11/2014 Liu ..... G03G 15/0233 399/176
9,157,561 B2 * 10/2015 Martin ..... F16L 37/35
9,166,352 B2 * 10/2015 Hansen ..... E21B 17/028
9,306,340 B2 * 4/2016 Chen ..... H01R 13/6616
9,466,916 B2 * 10/2016 Li ..... E21B 17/028
9,477,060 B2 * 10/2016 Sales Casals ..... H01R 24/28
9,553,399 B2 * 1/2017 Sales Casals ..... H02G 1/10
9,559,463 B2 * 1/2017 Sales Casals ..... G02B 6/3887
9,761,962 B2 * 9/2017 Nicholson ..... H01R 13/523
9,876,308 B2 * 1/2018 Jones ..... H01R 13/523
2017/0183510 A1 * 6/2017 Fujisawa ..... C08G 18/10
2019/0081435 A1 * 3/2019 Lewin ..... H01R 13/5208

FOREIGN PATENT DOCUMENTS

EP 2457292 B1 5/2015
EP 3148009 A1 3/2017
WO 2017133950 A1 8/2017

* cited by examiner

COUPLING MEMBER FOR ELECTRICAL CONNECTION

CROSS REFERENCE TO RELATED APPLICATIONS

This application is the US National Stage of International Application No. PCT/EP2018/075029 filed 17 Sep. 2018, and claims the benefit thereof. The International Application claims the benefit of United Kingdom Application No. GB 1715827.0 filed 29 Sep. 2017. All of the applications are incorporated by reference herein in their entirety.

FIELD OF INVENTION

The present disclosure relates to a coupling member for making an electrical connection.

BACKGROUND

Coupling and uncoupling of electrical connectors is a common requirement in many industries. Where electrical connectors are coupled and uncoupled subsea, i.e. wet-pluggable or wet-mateable, electrical insulation as well as pressure balance are required to ensure reliable operation.

For these purposes it is known to house an electrical contact in an internal cavity filled with a dielectric liquid, such as oil. Any external pressure acting on the connector is equalised internally by the dielectric liquid, alleviating a pressure differential that may act on seals. Moreover, the dielectric liquid serves to electrically insulate the conductor. However, contamination of the dielectric liquid, for example as a result of seawater ingress, dilutes the dielectric liquid and leads to electrical stresses. Particularly in medium and high voltage applications, this may quickly cause failure of the electrical connector.

Reduction of the dielectric property is conventionally addressed by separating the internal cavity into an arrangement of nested chambers. An outer (or 'primary') chamber houses an inner (or 'secondary') chamber in which the conductor is located. The outer chamber provides a barrier to ingress of contaminants so that the inner chamber is less exposed to contamination. Nevertheless, contamination of the inner chamber still occurs, particularly as a result of repeated mating and de-mating, with the result that the dielectric liquid continues to be diluted, and the electrical insulation reduced.

Hence a wet-pluggable electrical connector with improved electrical insulation is highly desirable.

SUMMARY

According to the present disclosure there is provided an apparatus as set forth in the appended claims. Other features of the invention will be apparent from the dependent claims, and the description which follows.

Accordingly there may be provided a wet-mateable coupling member for making an electrical connection. The coupling member comprises a body having a cavity wall which defines an internal cavity, and a hollow sleeve located inside the internal cavity. The sleeve is located inside the internal cavity to define an outer chamber between the sleeve and the cavity wall and to define an inner chamber inside the sleeve. The sleeve comprises an electrically-insulating layer and an electrically-conductive layer, the electrically conductive layer defining an outer surface of the sleeve in the outer chamber and comprising a semi-conductive layer, the semi-conductive layer being a conductive elastomer. An electrical contact is adapted to be housed inside the inner chamber and configured for making said electrical connection.

Hence there is provided a wet-mateable coupling member suitable for medium and high voltage applications.

The coupling member may further comprise a second electrically-conductive layer which defines an inner surface of the sleeve.

The second electrically-conductive layer may be electrically connected to the electrical contact.

The electrically-conductive layer which defines the outer surface of the sleeve may be configured to connect to electrical ground.

The electrically-insulating layer may be provided between electrically-conductive layers.

The layers of the sleeve may be formed integrally with each other.

The sleeve may comprise a head portion, the head portion provided with: an access aperture and an access passageway which extends between the access aperture and the inner chamber, wherein the access passageway is defined by an inner surface of the head portion which forms part of the electrically-insulating layer.

The coupling member may further comprise a shuttle pin moveably arranged in the access passageway, wherein the shuttle pin is moveable between a first position and a second position, in the first position the access passageway is sealed and in the second position the access passageway is open.

The sleeve may comprise a tail portion, the tail portion forms: a socket opening, and a socket passageway which extends between the socket opening and the inner chamber, wherein the socket passageway is defined by an inner surface of the tail portion which forms part of the electrically-insulating layer.

The insulating layer may comprise an insulating elastomer.

The internal cavity may be configured to retain a dielectric liquid.

According to another example there may be provided a coupling assembly comprising the coupling member, wherein the electrical contact comprises part of a socket; and the coupling assembly further comprises a further coupling member for making said electrical connection with the coupling member, wherein the further coupling member comprises an electrically-conductive pin arranged to be received into the socket.

The electrically-conductive pin may have a conductive outer surface.

BRIEF DESCRIPTION OF THE DRAWINGS

Examples of the present disclosure will now be described with reference to the accompanying drawings, in which.

DETAILED DESCRIPTION

The present disclosure relates to an electrical connector for making an electrical connection. More particularly, the electrical connector is suitable for making the electrical connection and breaking thereof underwater. The electrical connector may comprise an assembly of coupling members arranged to engage mechanically in order to close an electrical circuit when brought from an uncoupled configuration to a coupled configuration.

Conventionally, electrical connectors have been provided with insulating rubber over an electrically conducting pin of the connector. In the core of the pin, there may be a high voltage, whereas outside the pin may be at low or zero voltage. The rubber coated pin is typically housed in a sealed volume containing a dielectric liquid, or oil. The oil may suffer electrical stress from the electrical field from the high voltage at the pin, straying through the rubber to the surrounding oil. The quality of the oil naturally deteriorates with time and there is a risk of contamination of the oil, both of which may lead to damage to the connector from electrical stress.

The present invention addresses this problem by using different material around the pin, to prevent stray electric fields getting to the dielectric medium and allow the dielectric medium to simply operate as a pressure compensator in the connector, rather than having to maintain the purity and quality of the oil to prevent damage due to electrical stress.

Figure 1:
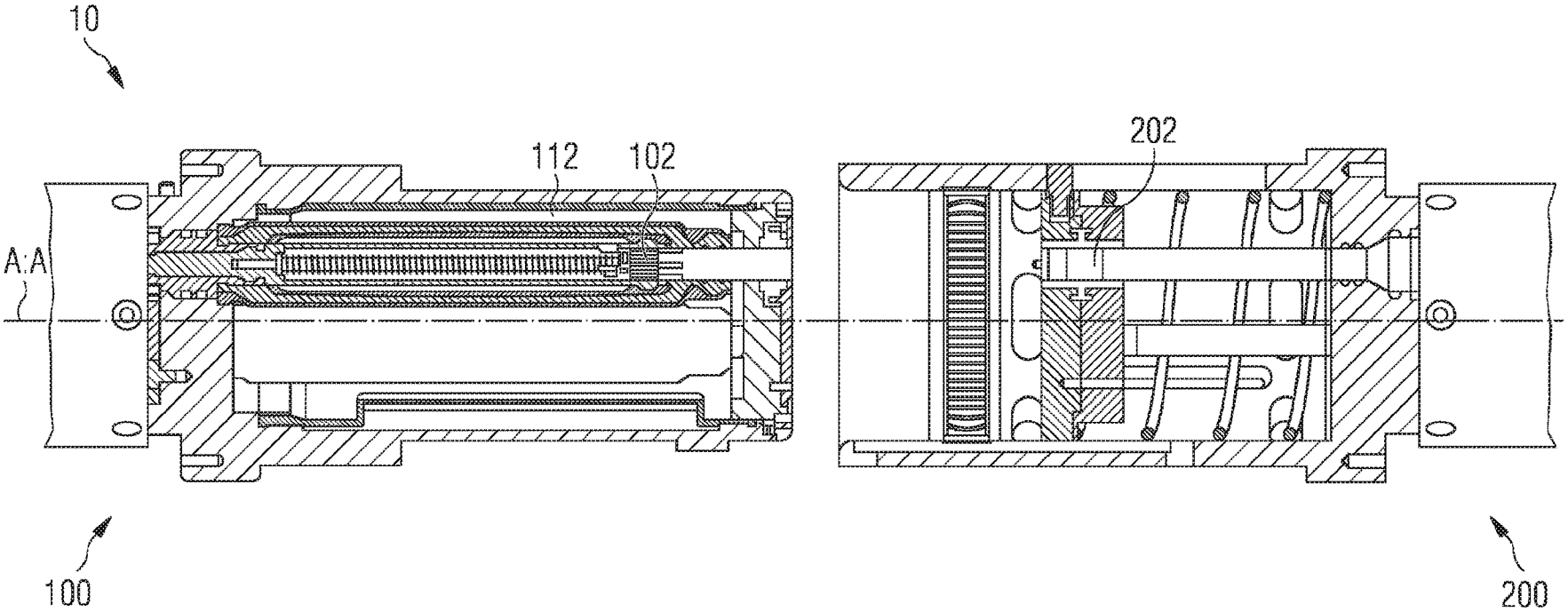
FIG. 1 shows a partially cut away side view of a coupling assembly in an uncoupled configuration.

An inner semi-conductive layer may be provided, which also smoothes the pin profile and an outer semi-conductive layer prevents stray electric fields from reaching the dielectric medium. This protective effect significantly improves the electrical performance of the connector. The semi-conductive layer typically comprises a mix of a polymer and a conductor such as carbon, or graphite although other types of semi-conductive material may be used. This combination of partial insulation and weak conduction acts as a shield around the conductor. FIG. 1 shows a partially cut away view of a coupling assembly 10 according to the present disclosure. The coupling assembly comprises a pair of coupling members 100, 200, i.e. a first coupling member 100 and a second coupling member 200. The first coupling member, which is also known as a plug 100, and the second coupling member, which is also known as a receptacle 200, are each directly terminated to a subsea cable to make a subsea (electrical) connector pair. Accordingly, the coupling members are provided as a male coupling member 100, and a female coupling member 200.

Electrical contacts are housed in each coupling member 100, 200. Mating the coupling members is effected by bringing the coupling members together to insert the male coupling member into the female coupling member. De-mating of the coupling members is effected by separating the coupling members. Mating and de-mating is effected by relative linear motion along a coupling axis A:A. In other words, the coupling members are configurable between a mated (or 'coupled') configuration and a de-mated (or 'uncoupled') configuration. When the coupling members are brought into the mated configuration, the electrical contacts can be brought together to close an electrical circuit. When the coupling members are brought into the de-mated configuration, the electrical contacts are separated to break the electrical circuit.

The coupling assembly 10 is configured for mating and de-mating without exposing the electrical contacts. As explained earlier, this is a requirement for a wet-mateable coupling assembly. An electrical contact of at least one coupling member 100, 200 is housed inside a sealed volume filled with dielectric liquid. According to the present example, the male coupling member 100 houses an electrical contact 102 in a sealed volume. Moreover, the sealed volume is arranged to receive a matching electrical contact 202 of the female coupling member to thereby close the electrical circuit.

Figure 2:
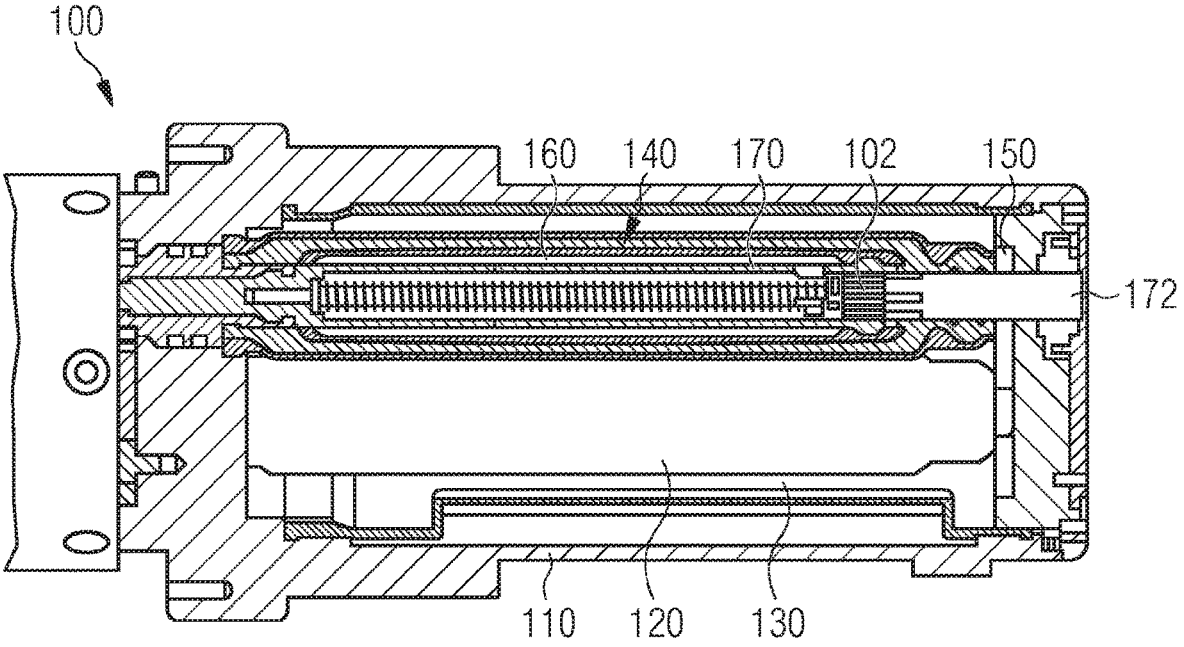
FIG. 2 is a partially-cut away side view of a male coupling member.

FIG. 2 shows a partially cut away side view of the male coupling member 100.

The male coupling member 100 comprises a body 110. The body may alternatively be referred to as a housing 110 or a projection 110. The body 110 is arranged to be received by the female coupling member 200. The body may have any suitable shape for insertion into the female coupling member.

The body 110 is configured to house and electrically insulate the electrical contact 102. The body defines an internal cavity 120. More particularly, the internal cavity is defined (or 'delimited') by a cavity wall 112 (or internal wall) of the body.

The internal cavity 120 is electrically insulated. The cavity wall 112 comprises an outer diaphragm 130 (or 'primary diaphragm') configured to provide pressure compensation. According to the present example, the outer diaphragm has a single layer. Furthermore, the internal cavity is filled with a dielectric liquid which may be any compressible fluid that permits pressure compensation and electrical insulation, for example oil.

A sleeve 140, or inner diaphragm 140 or secondary diaphragm 140, is provided inside the internal cavity 120.

The sleeve 140 is configured to house the electrical contact 102. The sleeve is hollow and thus divides the internal cavity 120 into an outer chamber 150, located outside the sleeve, and an inner chamber 160, located inside the sleeve. The outer chamber is delimited by the cavity wall 112 and the sleeve 140. More particularly, the outer chamber is delimited by the outer diaphragm of the internal wall, which is present in this example embodiment, and an outer surface of the sleeve. The inner chamber is delimited by an inner surface (or 'inside surface') of the sleeve. In other words, the outer chamber encloses the sleeve, and the sleeve encloses the inner chamber. The outer chamber and the inner chamber may alternatively be referred to as an outer cavity portion and an inner cavity portion, respectively.

Figure 3:
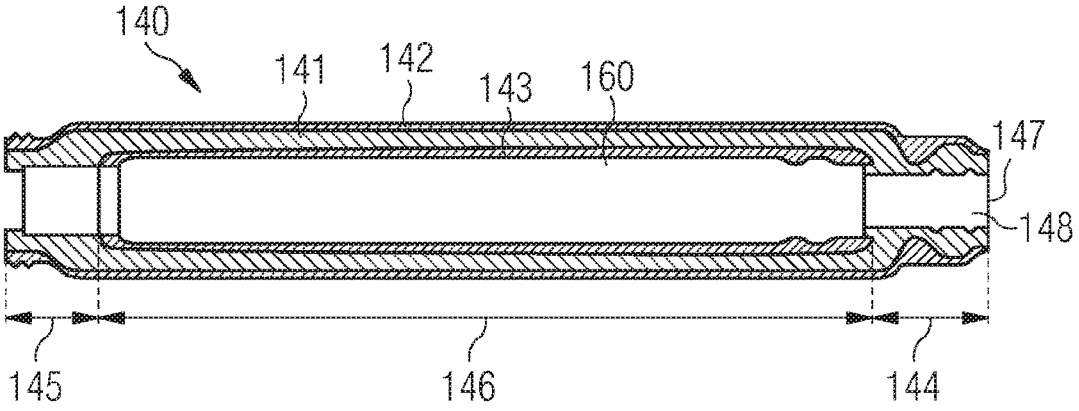
FIG. 3 is a cross-sectional side view of a sleeve.

FIG. 3 shows a cross-sectional view of the sleeve 140. The sleeve is configured to electrically insulate the inner chamber 160. More particularly, the sleeve is configured to electrically insulate the electrical contact 102 housed therein and, when mated with the female coupling member 200, to insulate also the electrical contact 202 of the female coupling member. The sleeve is configured to provide a barrier to electric charge as well as a barrier to an electric field generated by the electric charge.

The sleeve 140 comprises at least one electrically-insulating (or 'non-conductive') layer 141. The electrically-insulating layer provides a barrier to electric charge, i.e., the insulating layer inhibits the flow of electrical charge, or. electrical current, through the sleeve, for example, electrical current or electrical charge which may be caused by the electrical contacts 102, 202. The sleeve 140 also comprises at least one electrically-conductive layer 142, 143, typically a semi-conductive layer, to reduce electrical stress caused by electrical charge present, particularly, inside the sleeve.

According to the present example, the electrically-insulating layer 141 is provided between the electrically-conductive layers 142, 143, although with only an electrically conductive layer outside the insulating layer electrical shielding may still be provided. For the arrangement shown, the sleeve 140 has an outer semi-conductive layer 142 and an inner semi-conductive layer 143, and the insulating layer 141 is provided between the conductive layers. The outer electrically-conductive layer defines an outside surface of the sleeve. The inner electrically-conductive layer defines an inside surface of the sleeve.

A socket 170 comprising the electrical contact 102 is housed inside the inner chamber 160. The socket is generally elongate and cylindrical. The socket and the sleeve 140 are arranged generally coaxially, i.e. arranged concentrically in cross-section.

Figure 4:
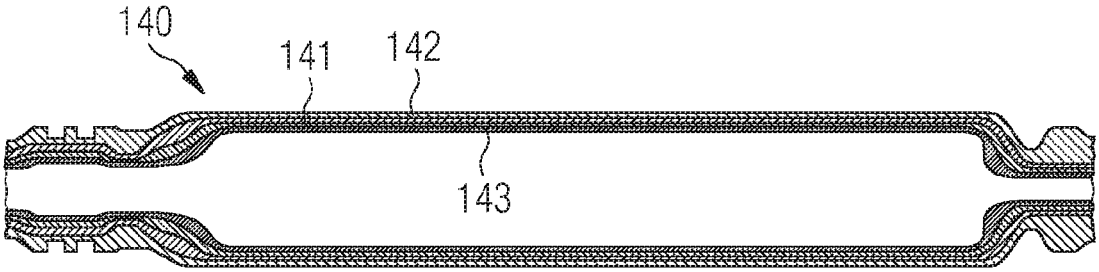
FIG. 4 is a schematic illustration of voltage distribution about the sleeve of FIG. 3.

FIG. 4 shows a schematic illustration of a distribution of electric potential about the sleeve 140 caused by electric charge present inside the sleeve, i.e. located in the inner chamber 160.

The inner semi-conductive layer 143 is electrically connected to the socket, causing the inner semi-conductive layer to be at the same electric potential as the socket. Accordingly, the inner chamber 160 is uniformly at a single electrical potential. In other words, no electric stress is created by electric charge of the electric contact 102. The skilled person will be familiar with the underlying physical principle according to which no electric field exists inside an ideal conductor.

The insulating layer 141 insulates the inner semi-conductive layer 143 and is thus configured to prevent electric charge from flowing from the inner semi-conductive layer to the outside of the sleeve.

The outer semi-conductive layer 142 is configured to screen the electric field generated by the inner semi-conductive layer 143. As the inner semi-conductive layer is electrically connected to the socket 170 and electrically insulated by the insulting layer 141, the inner semi-conductive layer may in general be at an electric potential different to that of the outer chamber 150. Accordingly, electrical stress would be caused but the outer semi-conductive layer acts to screen the inner semi-conductive layer and thus prevent said electrical stress.

The sleeve 140 according to the present application therefore differs from a conventional sleeve possessing only a single insulating layer and no semi-conductive layers. For a conventional sleeve, the dielectric liquid in the inner chamber as well as in the outer chamber is required to provide electrical insulation to reduce electric stress cause by electric charge present inside the conventional sleeve. Conventional electric stress control therefore critically depends on the quality (or purity) of the dielectric liquid, and diminishing thereof may ultimately lead to failure of the electrical connector. By contrast, the sleeve according to the present application provides electric stress control independent of the quality of the dielectric liquid. Stress control is instead solely determined by the properties of the sleeve. Notably, the manufacturing process of the sleeve may be well-controlled to keep contamination of the sleeve to a minimum.

Hence the present disclosure provides a wet-mateable coupling member 100 for making an electrical connection. The coupling member 100 comprises the body 110 having the cavity wall 112 which defines the internal cavity 120, the hollow sleeve 140 located inside the internal cavity, the sleeve arranged in the internal cavity to define the outer chamber 150 between sleeve and the cavity wall. The sleeve defines the inner chamber 160 inside of the sleeve, the sleeve comprising the electrically-insulating layer 141 and the electrically-conductive layer 142, 143. The electrical contact 102 is housed inside the inner chamber and configured for making said electrical connection.

According to the present example, the sleeve 140 is generally cylindrical. Moreover, the sleeve comprises a head portion 144 and a tail portion 145. A middle portion 146 extends between the head portion and the tail portion. According to the present example, the middle portion is generally elongate, resulting in an overall elongate sleeve.

The tail portion 145 corresponds to a first end of sleeve 140. The tail end comprises a socket opening and a socket passageway connecting the socket opening to the inner chamber. The socket extends into the inner chamber through the socket passageway. According to the present example, the socket passageway is formed by an inner surface of the tail portion which is defined by the electrically-insulating layer 141. Moreover, at the tail portion the outer electrically-conductive layer 142 directly contacts the cavity wall 112, rather than the outer diaphragm 130, to connect the outer electrically-conductive layer to electrical ground.

The head portion 144 corresponds to a second end of the sleeve 140, which is opposite the first end. The head portion comprises an access aperture 147 (or 'mouth') through which, in use, the electrical contact 202 is inserted in order to close the electrical circuit. The head portion comprises an access passageway 148 extending between the access aperture and the inner chamber 160. That is, the access passageway is configured for passing an electrical contact into the inner chamber. The passageway is formed by an inner surface of the head portion which is defined by the electrically-insulating layer. Thus, an exposed electrical contact, particularly the electrical contact 202, can be inserted through the access passageway yet remain electrically insulated.

A shuttle pin 172 is moveably arranged in the access passageway 148. The shuttle pin forms a mechanical seal with the body 110 to prevent leakage of dielectric liquid from the body. The shuttle pin is configured to physically seal the access passageway, by forming a gland seal with the sleeve 140, when the coupling member 100 is disconnected. Conveniently, the shuttle pin is configured to open the access passageway when the electrical contact 202 of the female coupling member 200 is inserted. The shuttle pin is moveable between an open configuration and a closed configuration. In the closed configuration, the shuttle pin extends into and completely seals the access passageway. In the open configuration, the shuttle pin is completely withdrawn from the access passageway and exposes the electrical contact 102. Conveniently, the shuttle pin is configured to be displaced by insertion of the electrical contact 202, so that the shuttle pin is pushed farther into the socket 170 and exposes the electrical contact 102 located therein.

Figure 5:
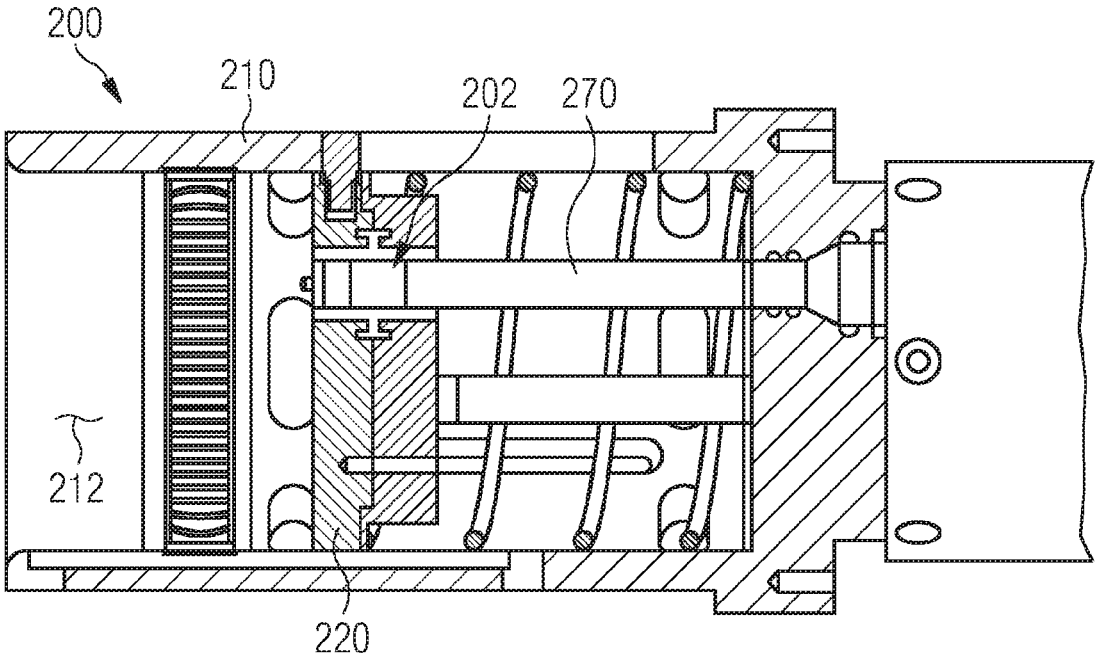
FIG. 5 shows a female coupling member.

FIG. 5 shows the female coupling member 200. The female coupling member comprises a body 210 (or 'housing'), forming a recess 212 into which the male coupling member 100 is received. The recess has a shape complementary to that of the male coupling member.

According to the present example, the electrical contact 202 of the female coupling member 200 is provided on a pin 270. The pin can be inserted into the socket 170 of the male coupling member 100 in order to close the electrical circuit.

The body 210 comprises a sheath 220 which is movable along the pin 270 between a sealed configuration, in which the electrical contact 202 is insulated, and an exposed configuration in which the electrical contact is exposed. In FIG. 5 the sheath is depicted in the closed configuration, insulating the electrical contact from an ambient environment.

The pin 270 has an electrically-conductive outer surface extending partway along the pin. For example, the outer surface of the pin may be metallised to provide a conductive coat. The conductive coat is configured to shield an electric field generated by electrical charge present inside the pin.

The conductive coat is configured to enclose (or 'surround') the interior of the pin. Conveniently, the conductive coat thus screens the electrical charge when the coupling members 100, 200 are mated. The conductive coat is provided at a portion of the pin which, when mated, does not extend into the sleeve 140 and, therefore, would not be shielded by the sleeve.

It is noted that a coupling assembly 10 according to the described example, which comprises the sleeve 140 with three layers 141, 142, 143 as well as the pin 270 with electrically-conductive outer surface, may completely remove electrical stress from the dielectric liquid as would otherwise be caused by electric charge of the socket or the pin.

Figure 6:
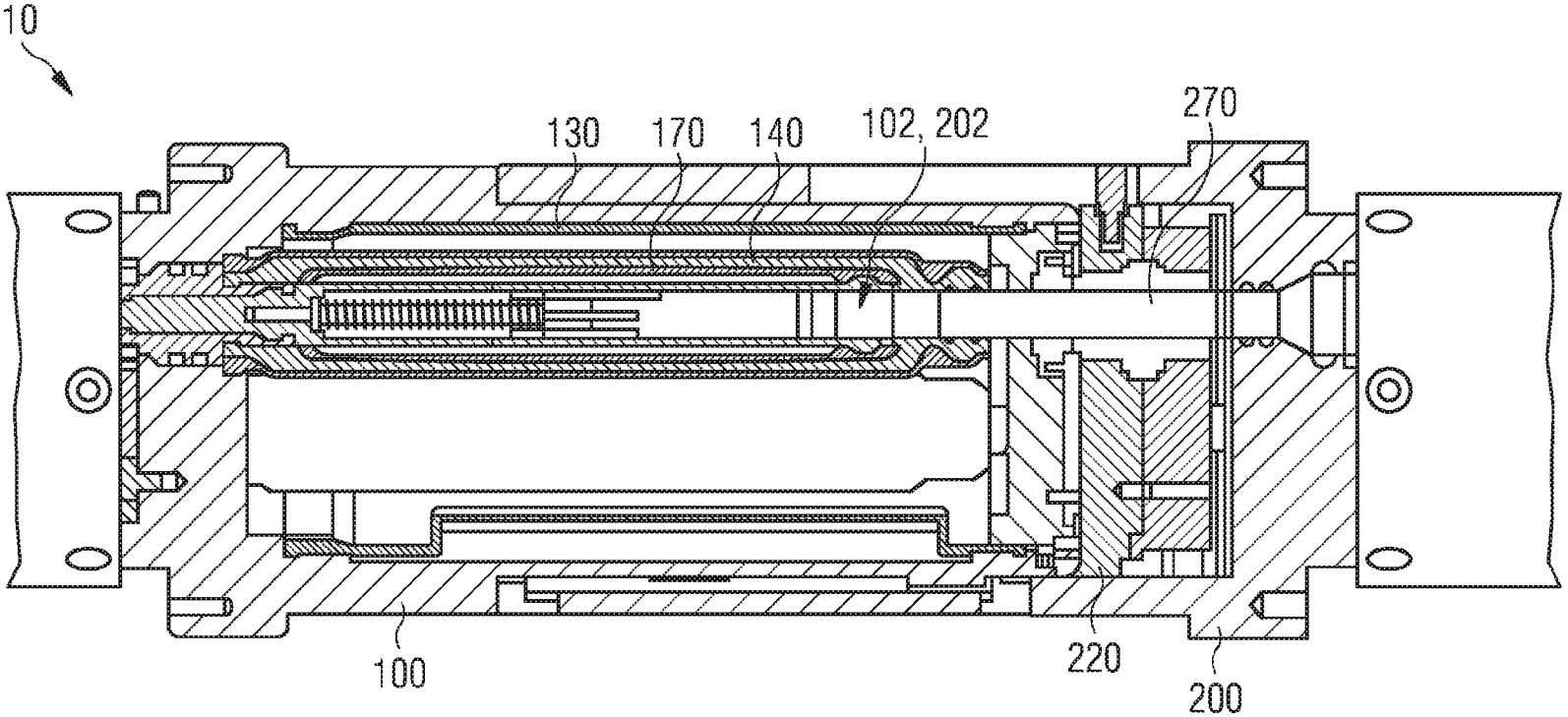
FIG. 6 shows a partially cut away side view of the coupling assembly in the coupled configuration.

FIG. 6 shows the male coupling member 100 and the female coupling member 200 in a coupled arrangement.

According to the present example, the coupling members 100, 200 are configured so that the electrical circuit is closed when the coupling members are in the coupled configuration.

During coupling, the body 110 of the male coupling member 100 is received into the recess 212 of the female coupling member 200 and brought into abutment with the sheath 220. In this arrangement, the pin 270 abuts the shuttle pin 172, which is in its closed position.

Urging the body 110 farther into the recess 212 causes the body to displace the sheath and causes the pin 270 to enter the body 110. In turn, the pin displaces the shuttle pin 172 from its closed position towards the open position. More particularly, as the pin causes the shuttle pin to be displaced, the shuttle pin withdraws from the outer chamber 150. Any liquid that may be present between the pin and the shuttle pin is thus dissolved into the dielectric liquid of the outer chamber. As the electrical contact 202 passes through the outer chamber, the dielectric liquid therein electrically insulates the electrical contact on the pin.

Further displacing the pin 270 by relative movement between the coupling members causes the pin to enter the access passageway 148 of the sleeve 140, and causes the shuttle pin 172 to be displaced the from the access passageway. Conveniently, the sleeve is flexible to allow expansion thereof in response to a pressure change caused by insertion of the pin. As the electric contact 202 passes through the access passageway, the inner surface of the access passageway, which is formed from the insulating layer 141, electrically insulates the electrical contact 202.

Further urging the coupling members 100, 200 together causes the pin 270 to enter the inner chamber 160 and brings the electrical contact 202 of the pin into contact with the electrical contact 102 of the socket. This also causes the sheath 220 to be fully displaced, and the coupling assembly 10 to be in the coupled arrangement. The coupling members are locked in the coupled arrangement by suitable means to prevent accidental uncoupling.

When in the coupled arrangement, the conductive coating of the pin 270 is in contact with the outer electrically-conductive layer 142 of the sleeve 140, thereby achieving earth continuity.

For breaking the electrical circuit, the pin 270 is withdrawn from the socket 170. The shuttle pin 172 is biased towards its closed position. Any suitable biasing means may be used such as, for example, a spring 174 extending through the socket. Conveniently, when the pin is fully withdrawn from the body 110, the shuttle pin is again in its closed position. Similarly, the sheath 220 is biased towards its sealed configuration so that as the body 110 is withdrawn from the recess 212, the sheath moves to seal the electrical contact 202 of the pin.

The sleeve 140 according to the present disclosure can be manufactured industrially. A suitable choice of material may comprise, for example, flexible elastomers, while a suitable process of manufacturing may include (injection) moulding.

More particularly, certain variants of elastomers are electrically-insulating, while other variants of elastomers are electrically-conductive. An electrically-conductive elastomer may be manufactured by addition of, for example, carbon, or graphite. The insulating layer 141 suitably comprises an insulating elastomer. Similarly, the semi-conductive layers suitably comprise a conductive elastomer. It is therefore possible to form the sleeve 140 with a plurality of layers, including at least one insulating layer and at least one semi-conductive layer.

When forming the layers 141, 142, 143 of the sleeve 140 using one or multiple elastomers, the sleeve is flexible and, in particular, capable of expanding or contracting in response to a pressure change inside the sleeve. Such a pressure change may occur, for example, as a result of insertion of the electrical contact 202 into the socket 170.

Conveniently, the sleeve is formed integrally so that the individual layers are directly interfaced. That is, two neighbouring layers are formed substantially without gaps formed between them. The sleeve 140 according to the present disclosure is a triple elastomeric moulding.

The sleeve 140 is configured to remove electrical stress from the coupling member 100 as a result of electrical charge being present inside the sleeve. Thus reliance on the dielectric liquid for electrical stress control is no longer required, which may, in particular, improve long-term operational reliability of the coupling member. That is, because the dielectric liquid of a conventional coupling member is subject to contamination in response to coupling and uncoupling which affects especially long-term reliability. By contrast, the coupling member according to the present disclosure is not adversely affected by a reduction of the dielectric property of the dielectric liquid.

The sleeve 140 can be tested and verified individually prior to assembly of the coupling member 100 in order to ensure its electrical performance. Thereby a risk of failure during final testing and operation may be reduced.

The sleeve 140 may be manufactured to have a low wall thickness. This is in contrast to a conventional sleeve, which has a relatively high wall thickness in order to ensure electrical insulation. Notably, although the sleeve 140 has multiple layers, their total thickness may be lower than that of a single-layered conventional sleeve.

In the example electrical connector illustrated in the figures, the sleeve has a generally cylindrical form. More generally, the sleeve is shaped to enclose the socket 170 and may have any other shape suitable for enclosing the socket.

According to the described example, the electrical connector is a three-phase connector. That is, although only a single socket/pin has been described, three sockets/pins are provided on the plug/receptacle. In other examples, a different multiple phase connector may be provided or a single phase connector.

In the example described above, the internal cavity 120 is filled with a dielectric liquid. As was explained, a sleeve according to the present disclosure provides electrical-stress control so that the dielectric properties of the dielectric liquid are not essential to the operation of the coupling member. Therefore a suitable non-dielectric liquid may alternatively be used. Nevertheless, a dielectric liquid may be used to further improve electrical insulation as well as for other purposes, such as lubrication, pressure equalisation.

According to the described example, the male coupling member comprises the socket. According to other examples, the female coupling member may comprise the socket.

All of the features disclosed in this specification (including any accompanying claims, abstract and drawings), and/or all of the steps of any method or process so disclosed, may be combined in any combination, except combinations where at least some of such features and/or steps are mutually exclusive.

Each feature disclosed in this specification (including any accompanying claims, abstract and drawings) may be replaced by alternative features serving the same, equivalent or similar purpose, unless expressly stated otherwise. Thus, unless expressly stated otherwise, each feature disclosed is one example only of a generic series of equivalent or similar features.

The invention is not restricted to the details of the foregoing embodiment(s). The invention extends to any novel one, or any novel combination, of the features disclosed in this specification (including any accompanying claims, abstract and drawings), or to any novel one, or any novel combination, of the steps of any method or process so disclosed.

The invention claimed is:

1. A wet-mateable coupling member for making an electrical connection, comprising:

a body having a cavity wall which defines an internal cavity; and a hollow sleeve located inside the internal cavity;

wherein the hollow sleeve is arranged in the internal cavity to define an outer chamber between the hollow sleeve and the cavity wall, and to define an inner chamber inside the hollow sleeve;

wherein the hollow sleeve comprises an electrically-insulating layer and an electrically-conductive layer, the electrically-conductive layer defining an outer surface of the hollow sleeve in the outer chamber and comprising a semi-conductive layer, the semi-conductive layer being a conductive elastomer;

wherein an electrical contact is adapted to be housed inside the inner chamber and configured for making the electrical connection; and wherein the hollow sleeve comprises a head portion, the head portion being provided with an access aperture and an access passageway which extends between the access aperture and the inner chamber, wherein the access passageway is defined by an inner surface of the head portion which forms part of the electrically-insulating layer, and/or a tail portion, the tail portion forming a socket opening, and a socket passageway which extends between the socket opening and the inner chamber, wherein the socket passageway is defined by an inner surface of the tail portion which forms part of the electrically-insulating layer.

2. The wet-mateable coupling member according to claim 1, further comprising:

a second electrically-conductive layer which defines an inner surface of the hollow sleeve.

3. The wet-mateable coupling member according to claim 2, wherein the electrically-conductive layer which defines the inner surface of the hollow sleeve is electrically connected to the electrical contact.

4. The wet-mateable coupling member according to claim 2, wherein the electrically-insulating layer is provided between the first and second electrically-conductive layers.

5. The wet-mateable coupling member according to claim 4, wherein the electrically-insulating and electrically-conductive layers of the hollow sleeve are integral with one another.

6. The wet-mateable coupling member according to claim 1, wherein the electrically-conductive layer which defines the outer surface of the hollow sleeve is configured to connect to electrical ground.

7. The wet-mateable coupling member according to claim 1, further comprising:

a shuttle pin moveably arranged in the access passageway, wherein the shuttle pin is moveable between a first position and a second position; wherein in the first position the access passageway is sealed and in the second position the access passageway is open.

8. The wet-mateable coupling member according to claim 1, wherein the electrically-insulating layer comprises an insulating elastomer.

9. The wet-mateable coupling member according to claim 1, wherein the internal cavity is configured to retain a dielectric liquid.

10. A coupling assembly comprising:

the wet-mateable coupling member according to claim 1;

wherein the electrical contact comprises part of a socket;

a further coupling member for making an electrical connection with the wet-mateable coupling member; and wherein the further coupling member comprises an electrically-conductive pin arranged to be received into the socket.

11. The coupling assembly according to claim 10, wherein the electrically-conductive pin has a conductive outer surface.

* * * * *